US007513098B2

(12) United States Patent
Ohri et al.

(10) Patent No.: US 7,513,098 B2
(45) Date of Patent: Apr. 7, 2009

(54) SWIRLER ASSEMBLY AND COMBINATIONS OF SAME IN GAS TURBINE ENGINE COMBUSTORS

(75) Inventors: Rajeev Ohri, Winter Springs, FL (US); Kristian I. Wetzl, Orlando, FL (US); Herbert C. Reid, Orlando, FL (US); Arthur J. Harris, Jr., Orlando, FL (US); David M. Parker, Oviedo, FL (US); Stephen E. Mumford, Longwood, FL (US)

(73) Assignee: Siemens Energy, Inc., Orlando, FL (US)

( * ) Notice: Subject to any disclaimer, the term of this patent is extended or adjusted under 35 U.S.C. 154(b) by 715 days.

(21) Appl. No.: 11/169,478

(22) Filed: Jun. 29, 2005

(65) Prior Publication Data

US 2007/0000228 A1 Jan. 4, 2007

(51) Int. Cl.
*F02C 3/14* (2006.01)
*F23R 3/30* (2006.01)

(52) U.S. Cl. ..... 60/39.11; 60/737; 60/748

(58) Field of Classification Search ..... 60/737, 60/748, 39.11, 800, 747
See application file for complete search history.

(56) References Cited

U.S. PATENT DOCUMENTS

| | | | | |
|---|---|---|---|---|
| 2,458,066 | A | | 1/1949 | Farkas et al. |
| 2,517,015 | A | | 8/1950 | Mock et al. |
| 2,586,751 | A | | 2/1952 | Watson et al. |
| 2,768,497 | A | | 10/1956 | Hayes |
| 2,999,359 | A | | 9/1961 | Murray |
| 3,703,259 | A | | 11/1972 | Sturgess et al. |
| 3,811,278 | A | | 5/1974 | Taylor et al. |
| 3,851,466 | A | | 12/1974 | Verdouw |
| 3,853,273 | A | | 12/1974 | Bahr et al. |
| 3,946,552 | A | | 3/1976 | Weinstein et al. |
| 3,982,392 | A | | 9/1976 | Crow |
| 4,271,675 | A | | 6/1981 | Jones et al. |
| 4,413,470 | A | | 11/1983 | Scheihing et al. |
| 4,584,834 | A | | 4/1986 | Koshoffer et al. |
| 4,653,278 | A | | 3/1987 | Vinson et al. |
| 4,726,192 | A | | 2/1988 | Willis et al. |
| 4,763,482 | A | | 8/1988 | Wehner |
| 5,220,786 | A | | 6/1993 | Campbell |
| 5,253,478 | A | * | 10/1993 | Thibault et al. ..... 60/748 |
| 5,490,378 | A | | 2/1996 | Berger et al. |
| 5,675,971 | A | | 10/1997 | Angel et al. |
| 5,680,766 | A | * | 10/1997 | Joshi et al. ..... 60/748 |
| 5,865,024 | A | | 2/1999 | Kress et al. |

(Continued)

*Primary Examiner*—Ted Kim

(57) ABSTRACT

A fuel/air mixing apparatus, such as a main swirler assembly (400) comprising a sleeve (410), provides for additional air entry around the perimeter of a bore (440) through which passes a fuel/air mixture. The additional air reduces or eliminates flashback during operation of a gas turbine comprising the assembly (400). In some embodiments, a plurality of gaps (464) exists between spaced apart tabs (462) along a downstream end (460) of the sleeve (410). During gas turbine operation, air flows through both a flashback annulus (411) and the gaps (464). In other embodiments, a plurality of holes are placed upstream and in line with the tabs (1004) to supplement the air flow through gaps (1006). In yet other embodiments, rows (1102) of holes (1104) are provided to supplement the airflow. Downstream ends (460,1218) may interface with a downstream-oriented lip (460) or with an upstream-oriented lip (1224). The interfacing may comprise a fit effective to damp vibration and to increase the natural frequency.

19 Claims, 12 Drawing Sheets

U.S. PATENT DOCUMENTS

| | | | | |
|---|---|---|---|---|
| 6,035,645 | A | 3/2000 | Bensaadi et al. | |
| 6,279,323 | B1 | 8/2001 | Monty et al. | |
| 6,427,435 | B1 | 8/2002 | Patterson et al. | |
| 6,442,940 | B1 | 9/2002 | Young et al. | |
| 6,481,209 | B1 | 11/2002 | Johnson et al. | |
| 6,581,386 | B2 | 6/2003 | Young et al. | |
| 6,672,073 | B2 | 1/2004 | Wiebe | |
| 6,705,087 | B1 | 3/2004 | Ohri et al. | |
| 6,732,528 | B2 | 5/2004 | Akagi et al. | |
| 6,775,983 | B2 | 8/2004 | Sanderson et al. | |
| 6,779,268 | B1 | 8/2004 | Farmer | |
| 6,832,481 | B2 * | 12/2004 | Koenig et al. | 60/748 |
| 2002/0011064 | A1 | 1/2002 | Crocker et al. | |
| 2003/0010034 | A1 | 1/2003 | Baudoin et al. | |
| 2003/0131600 | A1 | 7/2003 | David et al. | |
| 2004/0148938 | A1 | 8/2004 | Mancini et al. | |
| 2004/0226297 | A1 * | 11/2004 | Griffin et al. | 60/737 |
| 2005/0097889 | A1 * | 5/2005 | Pilatis et al. | 60/748 |

* cited by examiner

SWIRLER ASSEMBLY AND COMBINATIONS OF SAME IN GAS TURBINE ENGINE COMBUSTORS

FIELD OF THE INVENTION

The present invention relates generally to gas turbine engines, and more particularly to a combustor comprising at least one swirler assembly.

BACKGROUND OF THE INVENTION

In gas turbine engines, air discharged from a compressor section and fuel introduced from a fuel supply are mixed together and burned in a combustion section. The products of combustion are harnessed and directed through a turbine section, where they expand and turn a central rotor. For land-based gas turbine engines, the rotor so turned typically powers an electric generator to generate electricity.

A variety of combustor designs exist, with different designs being selected for suitability with a given engine and for achieving desired performance characteristics. One popular combustor design, known as a can-annular type design, comprises in each of a plurality of arranged "cans" a centralized pilot burner and a number of main fuel/air mixing apparatuses. The main fuel/air mixing apparatuses are arranged circumferentially around the pilot burner, and each such apparatus, during operation, produces a fuel/air mixture that is combusted. In order to ensure optimum performance, it is generally preferable that a respective fuel-and-air mixture is well mixed to avoid localized, fuel-rich regions. As a result, efforts have been made to produce combustors with essentially uniform distributions of fuel and air. Swirler elements, for example, are often used to produce a stream of fuel and air in which air and injected fuel are evenly mixed.

One objective in design and operation of gas turbine combustors is the stability of the flame and, related to that, the prevention of flashbacks. A flashback occurs when flame travels upstream from the combustion zone in the combustion chamber and approaches, contacts, and/or attaches to, an upstream component. Although a stable but lean mixture is desired for fuel efficiency and for environmentally acceptable emissions, a flashback may occur more frequently with a lean mixture, particularly during unstable operation. For instance, the flame in the combustion chamber may progress backwards and rest upon, for a period, a base plate which defines the upstream end of the combustion chamber. Less frequently, the flame may flash back into a fuel/air mixing apparatus, damaging components that mix the fuel with the air.

A multitude of factors and operating conditions provide for reliable, efficient and clean operation of the gas turbine combustor during ongoing operation. Not only is the fuel/air mixture important, but also relevant to gas turbine operation are the shape of the combustion area, the arrangement of assemblies that provide fuel, and the length of the combustor that provides varying degrees of mixing. Given the efficiency and emissions criteria, the operation of gas turbines requires a balancing of design and operational approaches to maintain efficiency, to meet emission standards, and to avoid damage due to undesired flashback occurrences.

The fuel/air mixing apparatus, and how it operates in relationship to other components, is one of the key factors in proper operation of current gas turbines. A common type of fuel/air mixing apparatus is known as a main swirler assembly. A main swirler assembly is comprised in part of a substantially hollow inner body that comprises stationary flow conditioning members (common forms of which also are referred to as vanes) that create a turbulent flow. Fuel from a fuel nozzle is added before or into this turbulent air stream and mixes to a desired degree within a period of time and space so that the air and fuel are well mixed upon combustion in the downstream combustion chamber. Also, in typical arrangements, a main swirler assembly also is comprised of an outer downstream element known as a sleeve. A sleeve (referred to in some references as an "annulus casting") surrounds a downstream section of the inner body, forming a channel for air flow known as the flashback annulus. In a typical arrangement, a quantity, such as eight, of swirler assemblies are arranged circumferentially around the central pilot burner. The pilot burner typically burns a relatively richer mixture than is provided by the radially arranged swirler assemblies.

Examples of approaches to reach a balance among the needs to reduce flashbacks, maintain reasonable initial costs, maintain operating efficiency, and reduce downtime and costs due to component failure, are provided in the following patents and applications: U.S. Pat. No. 6,705,087, issued Mar. 16, 2004 to R. Ohri and David M. Parker, U.S. patent application Ser. No. 10/984,526, filed Nov. 9, 2004, and entitled "An Extended Flashback Annulus", and U.S. patent application Ser. No. 11/051,799, filed Feb. 4, 2005, and entitled, Can-Annular Turbine Combustors Comprising Swirler Assembly And Base Plate Arrangements, And Combinations". These and all other patents, patent applications, patent publications, and other publications referenced herein are hereby incorporated by reference in this application in order to more fully describe the state of the art to which the present invention pertains, to provide such teachings as are generally known to those skilled in the art, and to provide teachings specific to embodiments of the present invention that utilize combinations of features that include one or more features and/or components described in the referenced patent applications.

Despite the advances in the art, there remains a need to provide more suitable designs related to combustors and main swirler assemblies to better solve flashback and other issues during gas turbine operation. This, in part, is due to the fact that the combustion dynamics of full-scale gas turbine engine combustors do not predictably or reliably scale from smaller model systems, which means that there is a greater degree of unpredictability for multi-feature combustors.

BRIEF DESCRIPTION OF THE DRAWINGS

The foregoing and other features of the invention will be apparent from the following more particular description of the invention, as illustrated in the accompanying drawings.

DETAILED DESCRIPTION OF THE INVENTION

Figure 1:
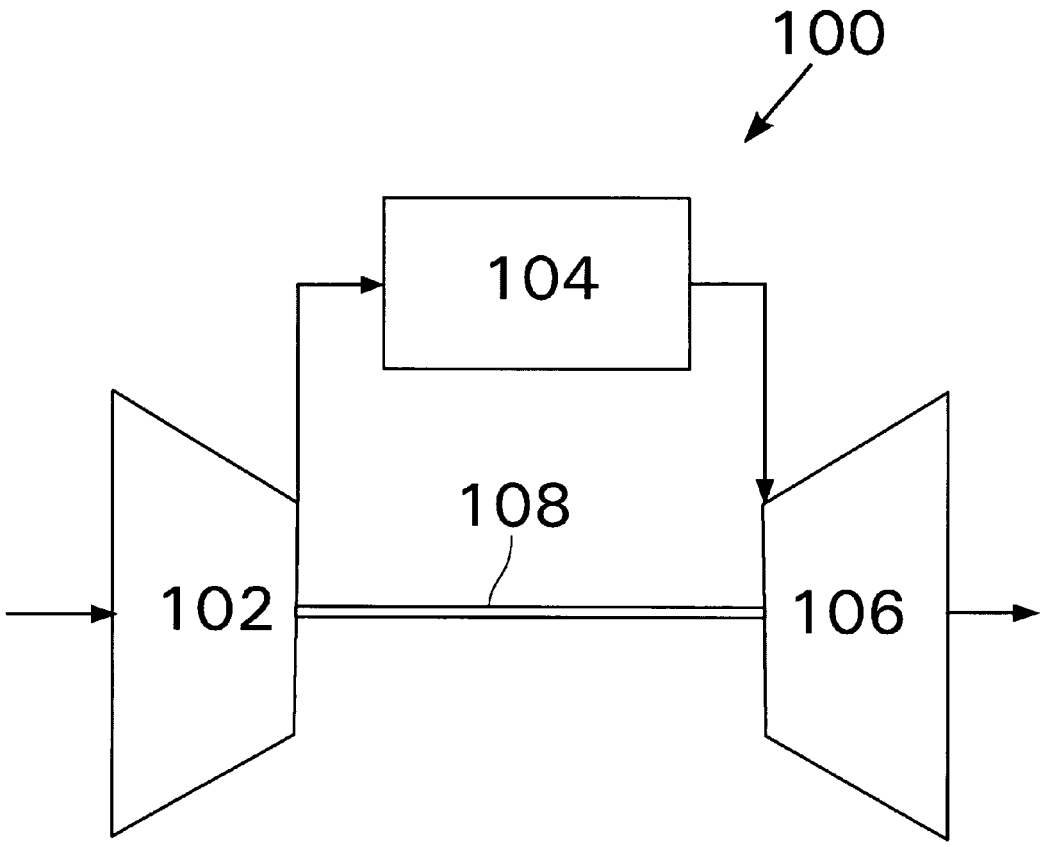
FIG. 1 is a schematic depiction of a gas turbine such as may comprise various embodiments of the present invention.

For modern gas turbine engine combustors, the attainment of a balance of durability and performance, is complicated by the wide range of necessary operating conditions and the relative unpredictability of acoustic and flashback damage. At the outset, it is recognized that the dynamics do not scale, so the ultimate evaluation is developed from operations of a full-scale combustor. In such operational use, one design modification may be found to solve a structural problem but to create or exacerbate a performance problem. Thus, appropriate problem-solving for a complex and dynamic gas turbine engine requires simultaneous consideration and resolution of multiple issues.

For example, the inventors of the present invention had determined that positive engagement of a combustor's main swirler assembly with the base plate improves the durability of components that attach the main swirler assembly to the combustor basket outer shell. A positive engagement was effectuated by sizing and installing the sleeve so that its downstream end fits within, and has radial contact with, the lateral edge defining the respective base plate opening. However, upon critical evaluation of gas turbine engines comprising this feature, evidence of flashback events was observed near the respective main swirler assembly.

Subsequently, the present inventors innovatively determined that the provision of air through a second peripheral air entry is beneficial and advantageously supplements air flowing through a first peripheral air entry, and thereby reduces or eliminates such flashback events. In prior art axial-flow main swirler assemblies, a peripheral air entry is provided via a flashback annulus channel formed between a sleeve and an inner body of the main swirler assembly. In embodiments of the present invention, a second peripheral air entry may be selected from a plurality of holes arranged on the sleeve toward its downstream end, a plurality of gaps at the downstream end formed between a plurality of spaced apart tabs, or both holes and gaps. Embodiments comprising both a first and a second peripheral air entry in an axial-flow main swirler assembly provide superior results with regard to the reduction or elimination of flashback damage, such as on the base plate near the respective main swirler assembly. Embodiments that have a positive engagement with the base plate, as described herein, also improve durability of attachment components.

Also, it has been appreciated that the provision of a second peripheral air entry provides opportunities to disperse more peripheral air to selected areas that may be most susceptible to flashback damage. Accordingly, in some embodiments the second peripheral air entry is adapted to provide relatively more air to selected areas adjacent the base plate.

Thus, toward optimal balancing of durability with performance, the present invention provides embodiments of main swirler assemblies that are in positive engagement with base plate lateral edges that define openings in combustor base plates, and that provide a first and a second peripheral air entry that, in combination, reduce or eliminate flashback events. However, it is appreciated that embodiments of the invention need not comprise main swirler assemblies in positive engagement with combustor base plate lateral edges that define openings for the respective main swirler assemblies. In this regard, the vibration-damping benefits may be achieved by other approaches.

Accordingly, the inventors of the present inventions have appreciated the importance of considering the durability criterion along with reduction of flashback. The present invention provides a solution toward obtaining an operationally stable, flashback-resistant main fuel/air mixing apparatus, such as a main swirler assembly, that is structurally durable. In some embodiments a main swirler assembly of the invention comprises a sleeve, such as an annular sleeve, that comprises, near or along its downstream end a plurality of passages providing a second peripheral air entry. These passages may comprise different shapes and patterns through which air flows so as to provide, in combination with a first peripheral air entry (i.e., a flashback annulus), a robust flow of air around a fuel/air mixture generated by the swirler assembly. In some embodiments this second peripheral air entry is comprised of a plurality of holes in the sleeve that typically are disposed toward the downstream end of the sleeve. In other embodiments the passages comprise a plurality of spaced apart tabs and intervening spaces that results in a non-continuous contact between the sleeve and the base plate at the base plate opening that receives a main swirler assembly of which the sleeve is a component. In some embodiments both a plurality of holes and intervening spaces between spaced apart tabs may be utilized to provide peripheral air entries to supplement the first air entry (i.e., the flashback annulus). These embodiments, respectively by themselves or, alternatively in combination with other features that also impact air flow along the periphery of a main fuel/air mixing apparatus, are effective in reducing or eliminating the occurrence of undesired flashback damage.

FIG. 1 provides a schematic depiction of a gas turbine 100 comprising a compressor 102, a combustor 104 (such as a can-annular combustor), and a turbine 106 connected by shaft 108 to compressor 102. During operation, compressor 102 provides compressed air to a combustor 104, which mixes the air with fuel, providing combusted gases to a turbine 106, which may generate electricity and which also turns compressor 102 by shaft 108. It is appreciated that a gas turbine 100 as shown in FIG. 1 may comprise in the respective combustor 104 any of the main swirler assemblies described and claimed herein comprising sleeves having gap and tabs and/or holes. In various embodiments, these are found in combination with appropriately meeting base plates.

Figure 4A:
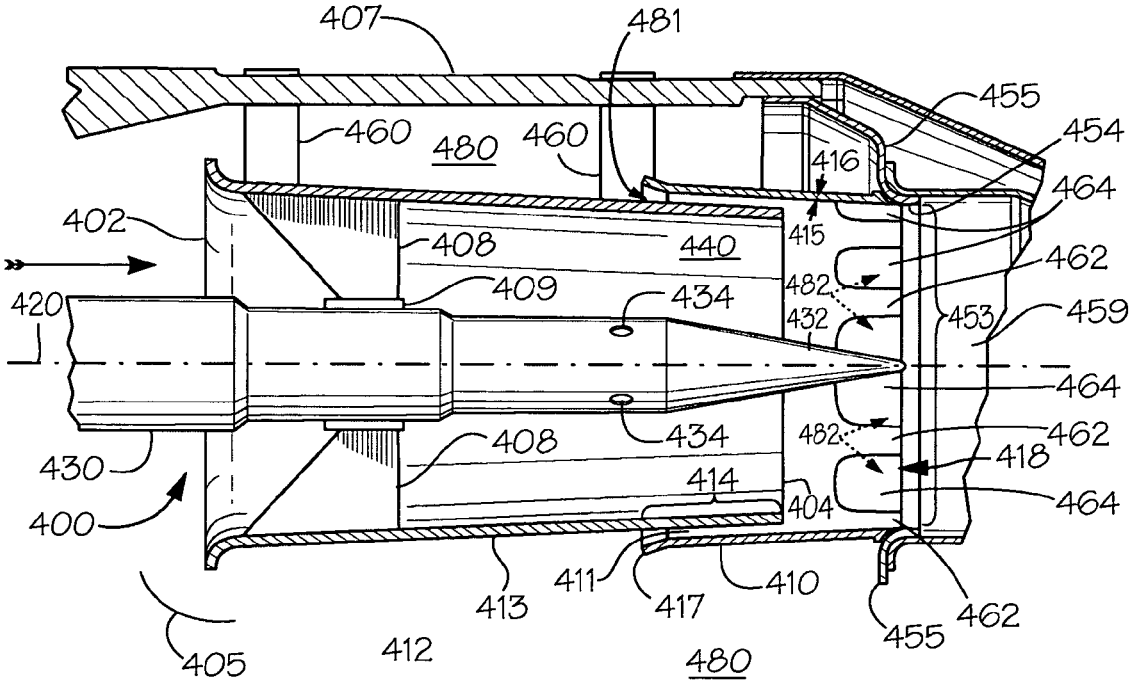
FIG. 4A is a cross-sectional side view one embodiment of a main swirler assembly of the present invention meeting a base plate according to the present invention. Also viewable are other components, in side cross section, of a gas turbine combustor.

FIGS. 2A, 2B, 4A to 6B and 8A to 12B provide side cross-sectional and perspective views of a number of embodiments of the present invention, including sleeves, and of those sleeves as part of main swirler assemblies, as the latter fit into openings of base plates. The sleeves depicted are annular, but this is not meant to be limiting. The discussion of FIG. 4A provides a relatively detailed description of the components of and related to a main swirler assembly. This description may be applied, as appropriate, to the components of and related to main swirler assemblies of other figures. For example, FIG. 4A depicts and describes a fuel nozzle 430. While this component is not shown in FIGS. 2B, 5B, 6B, 8B, 9B, 10B, 11B, and 12A, it is understood that a fuel nozzle (not necessarily limited to the one shown in FIG. 4A) fits into the embodiments in those figures, such as but not limited to the manner shown in FIG. 4A.

Figure 2B:
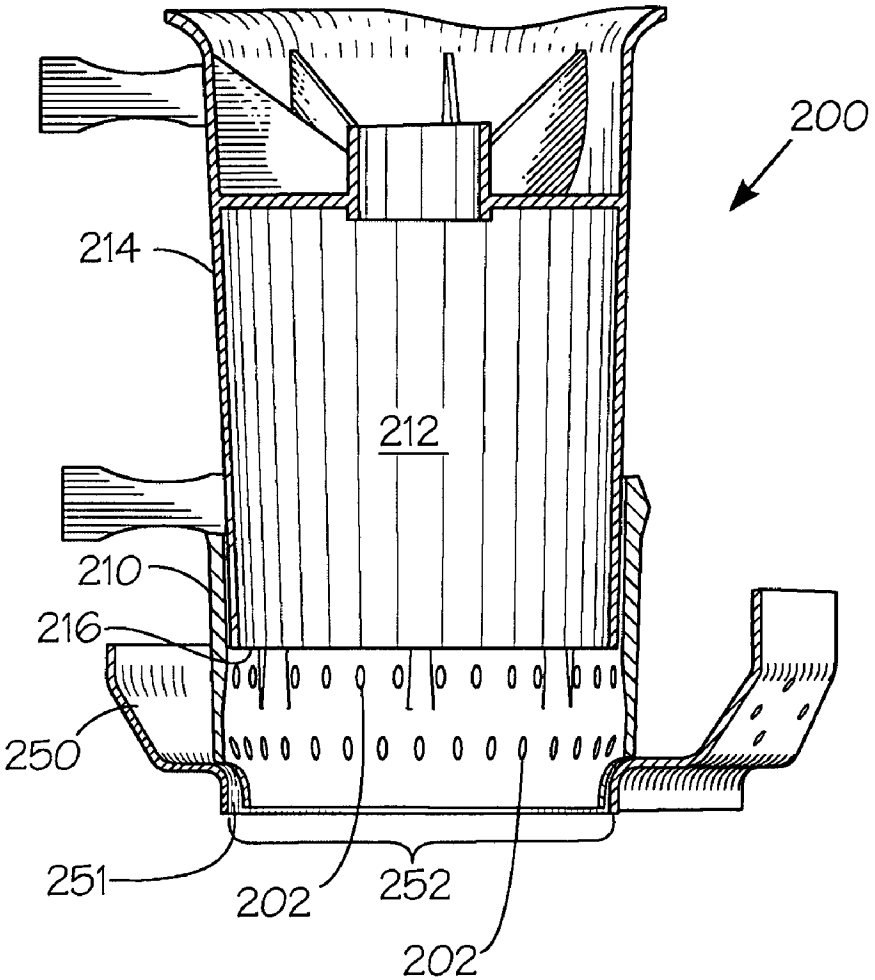
FIG. 2B depicts that sleeve embodiment in a cross-sectional side view of a main swirler assembly of the present invention meeting a base plate according to the present invention.
Figure 2A:
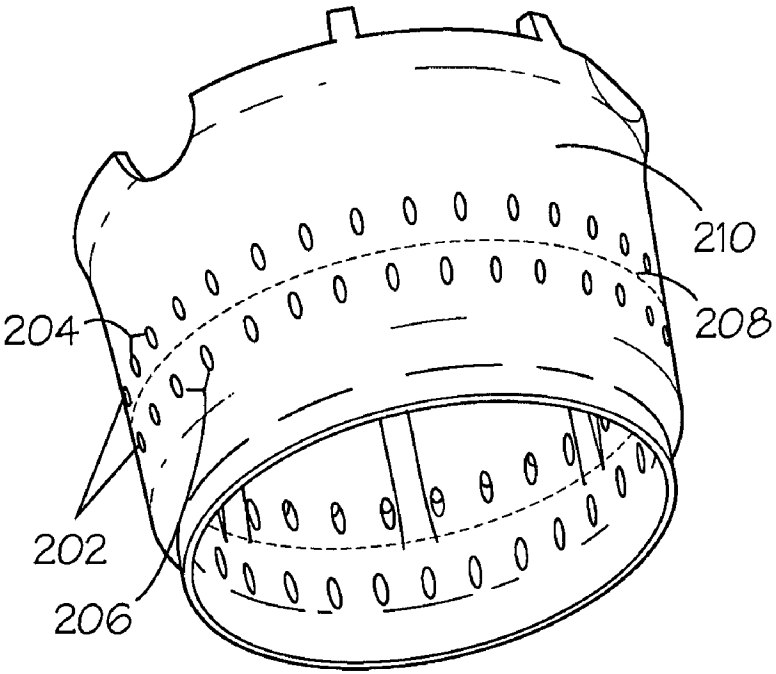
FIG. 2A is a perspective side view of a embodiment of a sleeve according to the present invention, showing concentric rows of holes.

One general approach to providing the second peripheral air entry is to provide a plurality of holes on a sleeve that is part of an axially arranged main swirler assembly. To depict this, FIG. 2A provides a perspective side view of a embodiment of a sleeve 210 according to the present invention, showing concentric rows of holes 202. FIG. 2B depicts that sleeve 210 in a cross-sectional side view of a main swirler assembly 200 of the present invention meeting a base plate 250 according to the present invention.

As seen best in FIG. 2A, the holes 202 are arranged in a first row 204, disposed at about the middle of the sleeve length, and a second row, 206, disposed more downstream than the first row 204. The holes span a circumference 208 of the sleeve 200. In one particular embodiment, the spaced apart holes 202 are drilled to incline inwardly and downstream at an angle of approximately 30 degrees, and have a diameter of about 1.8 millimeters ("mm"). A number of combinations of number of holes and size(s) of holes may be utilized, so as to achieve a net effect of providing a desired supplemental quantity of air into the combustor downstream of the base plate.

FIG. 2B depicts main swirler assembly 200 comprising an inner body 212 comprising a casing 214, and the sleeve 210. The main swirler assembly 200 is depicted positioned against a lateral edge 251 that defines an opening 252 of base plate 250. The lateral edge 251 is circular, as is the sleeve 210, and these meet so as to provide an 'engaged' fit as that term is defined herein. The two spaced apart rows 204 and 206 of spaced apart holes 202 are positioned downstream of an outlet end 216 of casing 214. However, this is not meant to be limiting, and holes may be utilized in embodiment in which the outlet end 216 extends to or below the holes. The holes provide a desired supplemental quantity of air that may be proportionally related to the total air flow from the main swirler assembly of which a sleeve bearing such holes is a component.

Further as to the fit between the downstream edge of a sleeve and a respective base plate opening, it is appreciated that a number of designs and types of fit may be effectuated. Traditional designs comprised an essentially axial relationship between the downstream edge of the sleeve (such as an annulus casting) and an adjacent surface of the base plate, so that during operation, when vibration tends to create periodic contact between nearby parts, and/or due to thermal expansion, there may be contact between the downstream edge of the sleeve and portions of the base plate opening a relatively small percentage of the time. As the designed spacing narrows, more frequent contact occurs, but this may become undesirable, such as due to wear and/or fatigue. However, in some embodiments herein a specific, vibration-damping fit of the interfacing components is achieved. Accordingly, as used herein, including the claims, the terms "engage," "engaged," and "engaging" are meant to indicate the implementation of a radial juxtaposition of the downstream end (or tab portions thereof) of the sleeve with a lateral edge of the base plate that defines the opening sized correspondingly for receiving that downstream end, wherein a damping, more particularly a substantial damping, of vibration is effectuated. In some embodiments, the tolerance for such engaging fit is between 0 and about 3 thousandths of an inch.

Figure 3:
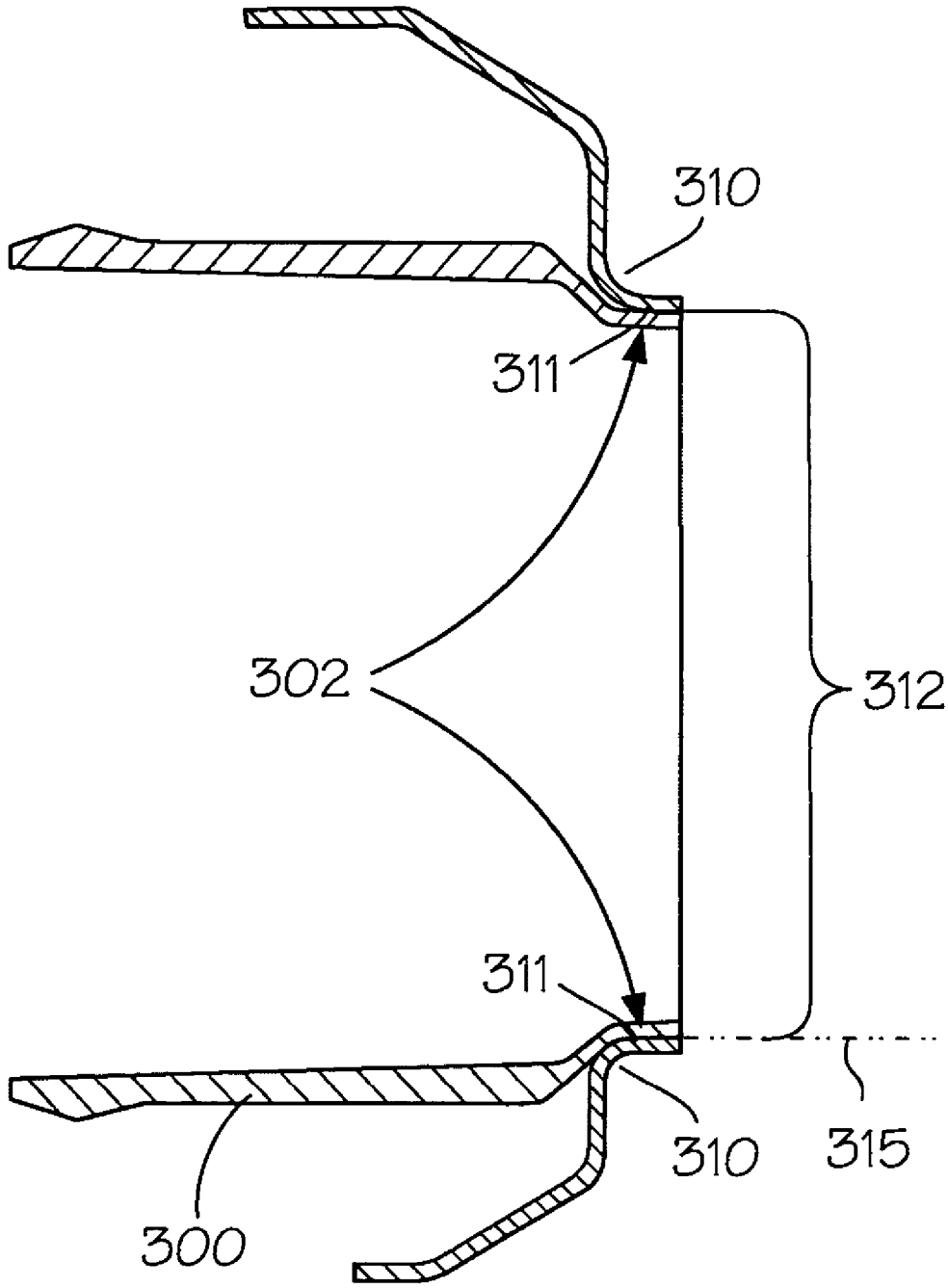
FIG. 3 is a close-up depiction of an axial positional relationship between a downstream end of a sleeve and a corresponding, mating lateral edge of an opening in a base plate of a combustor.

For example, FIG. 3 is a simplified depiction of one example of a radial juxtaposition of a downstream end 302 of a sleeve 300 with a corresponding, mating lateral edge 311 that defines opening 312 in a base plate 310 of a combustor (not shown in its entirety). It is noted that there is a radially-disposed engagement area 315 (shown as the contact area between respective arrows) due to the close radial fit of the more distal part of the downstream end 302 within the lateral edge 311. It is noted that embodiments of the present invention, as disclosed herein, including regarding FIG. 2B, may be in combustors in which the respective base plate/swirler assembly engagement is such as depicted in FIG. 3, that is, an engaged relationship, or, alternatively, is in other fit relationships. For example and comparison, but not to be limiting, an axial fit relationship, and a radially-disposed engagement, respectively, are shown in place in a main swirler assembly in FIGS. 4A and 4B.

Another general approach to providing the second peripheral air entry is to provide a plurality of gaps, interspersed between spaced apart tabs, at the downstream end of the sleeve. To depict this, FIG. 4A provides a cross-sectional side view one embodiment of a swirler assembly 400 comprising a sleeve 410 according to the present invention. In FIG. 4A, an exemplary main swirler assembly 400 is shown. The main swirler assembly 400 is not limited to any particular configuration, but its inner body 405 (here defined by a casing 412) will generally have a front end 402 and an exhaust end 404. The main swirler assembly 400 of FIG. 4A is generally cylindrical in shape, but a main swirler assembly of the present invention may be any shape, such as rectangular or polygonal, as dictated by design considerations and performance requirements. Also, in the shown embodiment, casing 412 of the swirler assembly 400, which defines the bore 440 through which an air/fuel mixture passes during operation, tapers from the flared inlet front end 402 to the exhaust end 404. Like other features of the swirler assembly, the casing 412 does not have to be tapered, and may have any suitable dimensions and any suitable contour. For example, a swirler assembly of the present invention may have a generally uniform cross-sectional profile along its length.

The main swirler assembly 400 comprises the inner body 405 and a sleeve 410 forming there between a flashback annulus 411, both of which structures as depicted are generally cylindrical. At a downstream end 460 of sleeve 410 are tabs 462 between which are cut-out sections lacking material providing gaps 464 between the tabs 462. These features of the sleeve 410 are more readily observed in FIG. 4C, described below, including the functioning of the gaps 464 to provide supplemental air flow during operation.

The direction of predominant air flow through the main swirler assembly 400 during operation is indicated by an arrow. At the front end 402 of main swirler assembly inner body 405 are viewable swirler flow conditioning members 408 (common forms of which are referred to as vanes in the art) which are rigid and impart turbulence upon the air flowing through the main swirler assembly inner body 405. An axis 420 for air flow is defined by a linear path between a front end 402 disposed upstream and the exhaust end 404 disposed downstream, and typically the swirler flow conditioning members 408 are disposed angularly relative to this axis so as to create turbulence upon the air flowing through the swirler assembly inner body. Fuel is supplied by way of a fuel delivery member 430, commonly referred to as a nozzle, comprising a fuel supply passage (not shown) and a rocket-shaped end 432 (noting, however that embodiments of the fuel delivery member are referred to by some in the art as a "rocket" in its entirety). The fuel supply passage is in fluid communication with a plurality of fuel exit ports 434 through which the fuel flows and is thereby dispersed into the flowing air through. The turbulence imparted by the flow conditioning members 408 provides for mixing of fuel and air in the hollow passage, or bore, 440 of the main swirler assembly inner body 405. The rod-like fuel delivery member 430 typically also provides some structural support, being attached to structural elements of a burner assembly (not shown in FIG. 4A), and in sliding engagement with a hub 409 to which are affixed the plurality of flow conditioning members 408. The rigid swirler flow conditioning members are rigidly coupled to the casing 412 along their respective peripheral edges, and also are collectively adapted to slidingly engage or otherwise couple the nozzle 430, which as depicted in FIG. 4A is centrally positioned in the bore 440 (and where the engagement is via hub structure 409).

Also, as shown in FIG. 4A, the main swirler assembly 400 is attached and stabilized by two pins 460, which can be welded to the main swirler assembly 400 at one end and welded or otherwise secured to the combustor outer liner 407. The pins 460 can be hour-glass shaped in profile to provide expanded welding footprints, or any other shape as is known in the art. Any number of pins may be used for attachment of a main swirler assembly to a liner. (Also, in some embodiments (not shown) an attachment connects from the sleeve 410 to the liner 407.) It is noted that the durability of the welds around pins such as pines 460 has been recognized to improve upon the implementation of an engaging radial fit between a respective main swirler assembly sleeve and a lateral edge defining an opening in the baseplate of the combustor. This arrangement of elements is exemplary but is not meant to be limiting.

As depicted in FIG. 4A, a substantially cylindrical casing 412 having an outer surface 413 surrounds and defines the bore 440 of the inner body 405. The flashback annulus 411 is the channel formed between a downstream section 414 of the casing 412 and the sleeve 410. Each sleeve 410 has a sleeve inner surface 415, an outer surface 416, an upstream end 417, and the downstream end 460. Also viewable is a base plate 455 comprising an opening 453 defined by a ring-like lateral edge 454. The downstream end 460 fits axially with base plate 455 about a curve inflecting from a barrier plane of the base plate 455 to the lateral edge 454.

Figure 4B:
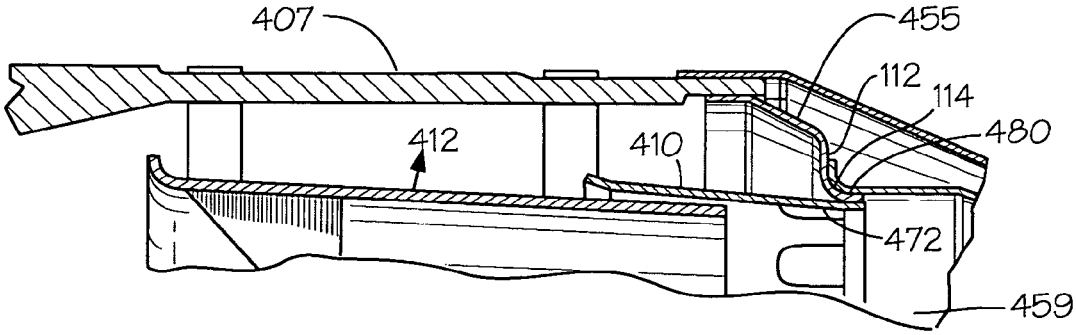
FIG. 4B provides a partial cross-sectional side view of a main swirler assembly similar to the one in FIG. 4A, however, depicting an extended sleeve providing for an engaging radial fit with the base plate.

It is noted that the positioning of the downstream end 460 of the sleeve 410 in FIG. 4A meets, but does not have an engaging fit with the base plate 455. FIG. 4B provides an example, not meant to be limiting, of an engaging radial fit. Components and features having the same identifying numbers in FIGS. 4A and 4B are taken to be the same. Referring to the differing features in FIG. 4B, for such a fit the outside diameter of the downstream end 472 of sleeve 410 is nominally equivalent to the inside diameter of the base plate lateral edge 480. This provides for a small clearance so there is metal-to-metal contact along a majority of a contact interface defined by the adjacent portions of downstream end 472 and lateral edge 480. This results in a damping of vibration and an increase in the resonant frequency of the main swirler assembly 400. The resonant frequency is directly related to the percentage of contact and inversely related to the degree of clearance and the percentage of gaps 464 along the downstream end 460 of the sleeve 410.

Figure 4C:
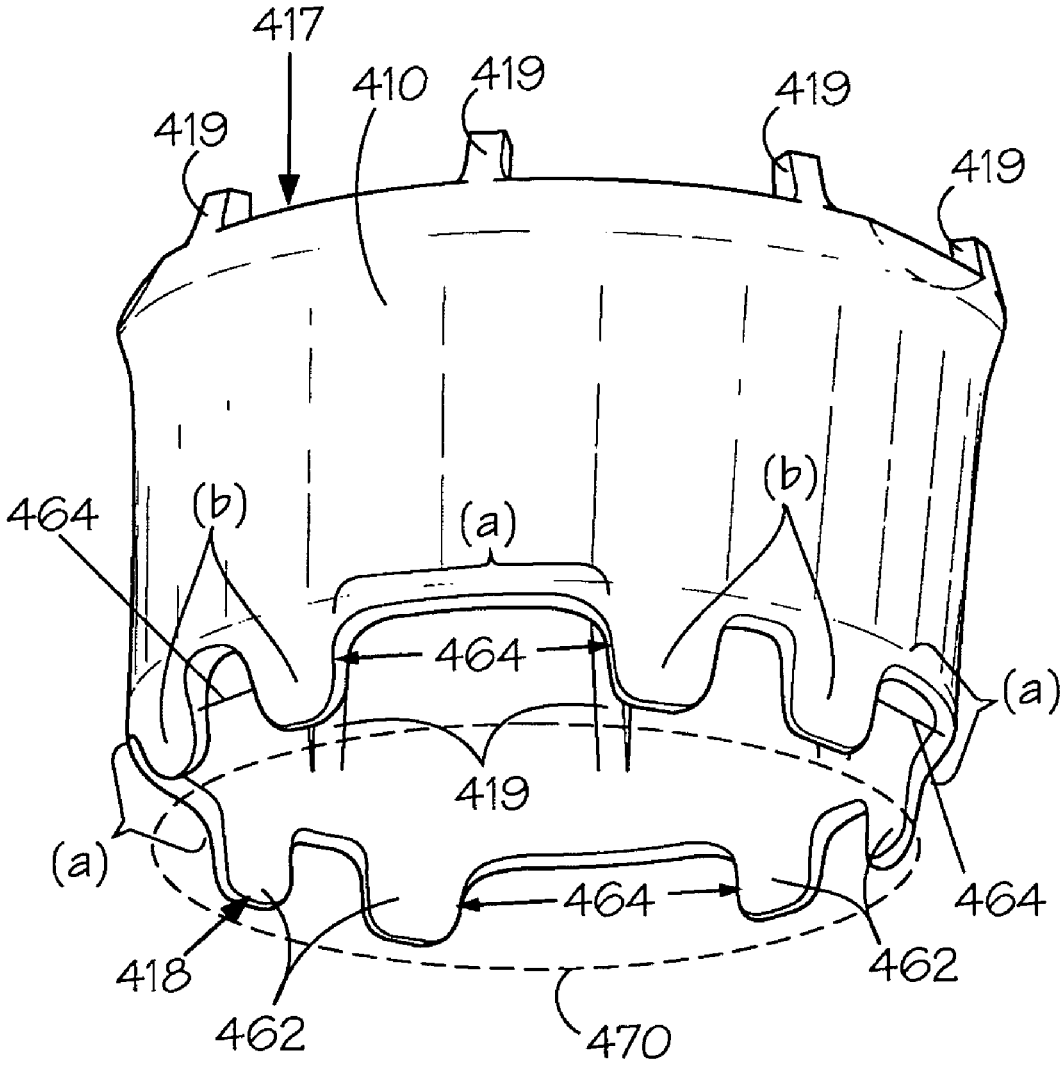
FIG. 4C is a side perspective view of a sleeve, such as depicted as part of the main swirler assembly of FIG. 4B, that comprises a plurality of gaps along its downstream end.

FIG. 4C provides a three-dimensional perspective view of the sleeve 410 shown partially in FIG. 4B. The sleeve 410 has upstream end 417 and downstream end 460. Along the downstream end 460 are eight tabs 462, each such tab 462 having a circumferential span (i.e., annular width) corresponding to 15 degrees of a 360-degree circle defining the circumference 470 of the sleeve 410 at its downstream end 460. The eight tabs 462 are spaced apart to define eight gaps 464 between the tabs 462. The tabs 462 are not uniformly spaced apart, so that four of the gaps (identified with an "a") are larger than four other gaps (identified with a "b"). Also viewable in FIG. 4C are spacing tabs 419; here these spacing tabs 419 are integral with sleeve 410. Spacing tabs (such as 419) establish a width of the flashback annulus 411 and provide structural support during operation by passing load from one component to the other. Spacing tabs (such as 419) may be integral or attached to either a sleeve (such as 410) or an outer casing of a main swirler assembly.

Considering both FIGS. 4B and 4C, it is appreciated that once positioned to engage the base plate in operational condition, each of said tabs 462 is adapted to engage a respective portion of the lateral edge 454 that defines the opening 453 of base plate 455.

As inferable from the nomenclature, a major purpose of the air flowing through the flashback annulus 411 is to discourage flashback occurrence. Without being bound to a particular theory, the basis for this is that a column of air released from the flashback annulus 411 serves as a barrier, for a distance, to prevent the flames in the combustor from 1) contacting the fuel/air mixture within it (from the respective main swirler assembly inner body) until that fuel/air mixture is sufficiently downstream in the combustor chamber and/or 2) moving backwards (i.e., upstream, toward the base plate, described below) either exteriorly of the normal path of the main fuel/air flows from the swirler assemblies or interiorly, between the pilot flame and the swirler assemblies. However, it has been appreciated that the air flow through a flashback annulus may not provide sufficient protection against flashbacks under various operating conditions with various combinations of components, and it has therefore been further appreciated that embodiments of a modified sleeve, such as are described herein, provides an additional quantity of supplemental air that is effective to reduce or eliminate flashback.

Referring to FIG. 4A, during operation in a gas turbine compressed air is present in a space 480 upstream of the base plate 455. In addition to the predominant flow through the bore 440 of the main swirler assembly 400, some of this air flows through the flashback annulus 411 (air flow indicated by small arrows 481). Air from this space 480 also flows through the gaps 464, as shown by arrows 482, crossing the opening 453 of base plate 455 downstream of the gaps 464. Thus, in this embodiment of the present invention, the flow of air along the periphery of main swirler assembly 400 results from a combination of flows from the flashback annulus 411 and gaps 464. Without being bound to a particular theory, it is believed that this design for supplementing the flashback annulus air flow provides for superior reduction, or elimination of, flashbacks under a range of gas turbine operating conditions. In testing a particular combination of main swirler assembly/combustor/turbine, under a range of operating conditions (isothermal, cold, hot day, heated fuel), flashback was not observed.

Figure 5B:
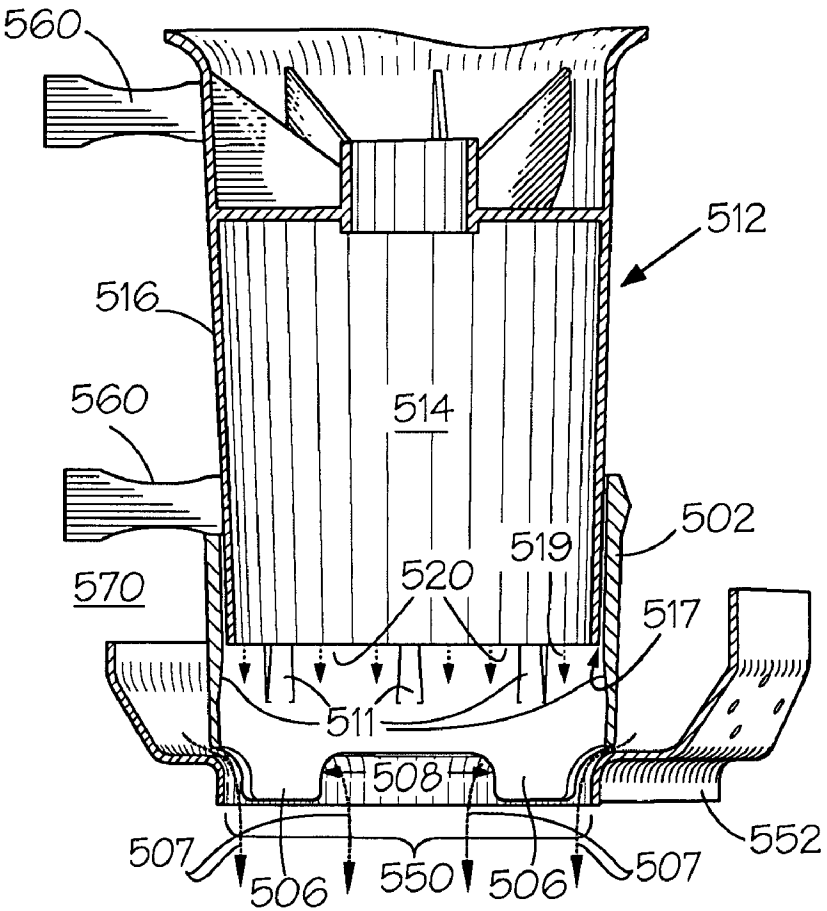
FIG. 5B depicts that sleeve embodiment in a cross-sectional side view of a main swirler assembly of the present invention meeting a base plate according to the present invention.
Figure 5A:
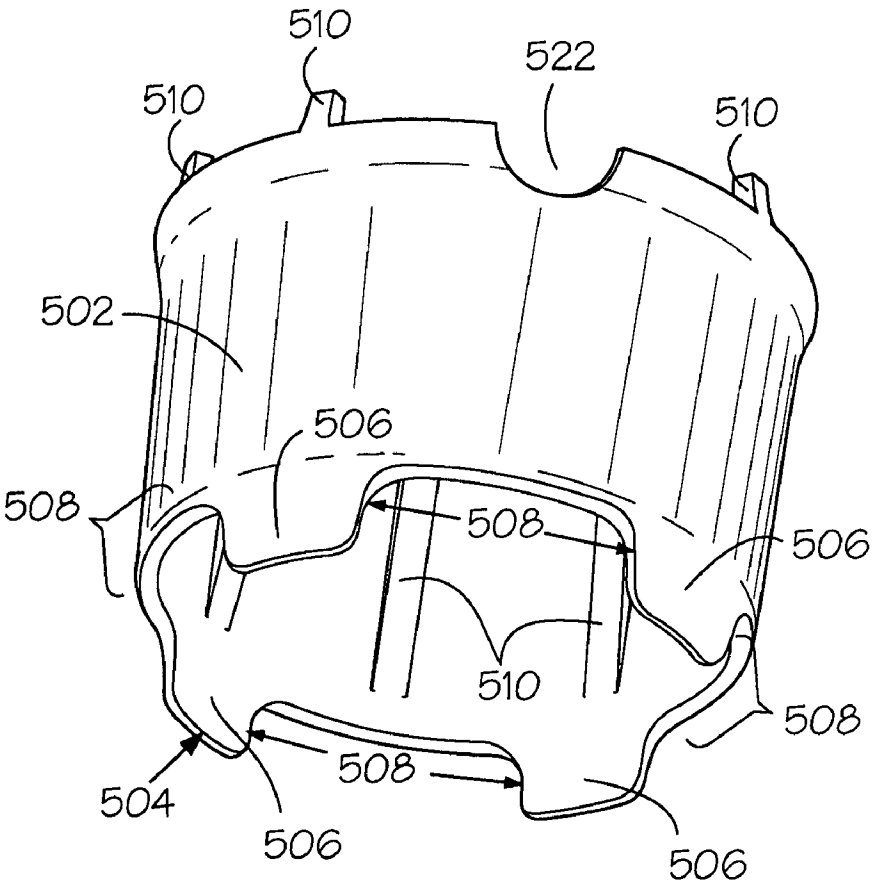
FIG. 5A is a perspective side view of an embodiment of a sleeve according to the present invention that comprises a plurality of gaps along its downstream end.

The arrangement of tabs and gaps depicted in FIGS. 4A-4C is not meant to be limiting of the scope of the present invention. Various combinations of gaps and spaces may be utilized, so as to provide sufficient engagement for structural support and vibration damping, and a total open area of the gaps to provide a desired quantity, or flow, of air from such second peripheral air entry. Thus, a plurality of tabs and gaps may be utilized along a downstream end of a sleeve of a main swirler assembly, or along any analogous structures to achieve this result For example, not to be limiting, FIG. 5A provides a three-dimensional perspective view of a sleeve 502 having an upstream end 503 and a downstream end 504. Along the downstream end 504 are four tabs 506, each such tab 506 having a circumferential span (i.e., annular width) corresponding to 30 degrees of a 360-degree circle defining the circumference of the sleeve 502 at its downstream end 504. The four tabs 506 are evenly spaced apart to define four identically sized gaps 508 between the evenly spaced tabs 506. Also viewable in FIG. 5A are spacing tabs 510, which provide for spacing between the sleeve 502 and a main swirler assembly, Referring to FIG. 5B, a side cut-away view of a main swirler assembly 512 comprising an inner body 514 within its casing 516, and the sleeve 502. The main swirler assembly 512 is depicted positioned into a respective opening 550 of base plate 552. So positioned, each of said tabs 506 is adapted to contact a respective portion of a lateral edge 551 that defines the opening 550 of base plate 552. It is noted that the cut-away sectioning is made through two of the eight spacing tabs 510, so that a flashback annulus is not readily viewable in this figure. However, the bottom ends 511 of some spacing tabs 510 are viewable, indicating the presence of a flashback annulus 520 formed between the downstream outer side of the casing 516 and an inner wall 517 of the sleeve 502.

As described for the embodiment of FIGS. 4A and 4B, during operation in a gas turbine, compressed air is present in a space 570 upstream of the base plate 552. This air flows through the flashback annulus 520 (with air flow indicated by small arrows 519 along the inner wall 517 of sleeve 502). Air from this space 570 also flows through the gaps 508, as shown by arrows 507 along the opening 550 of base plate 552 downstream of the gaps 508. Thus, in this embodiment of the present invention, the flow of air along the periphery of main swirler assembly 512 results from a combination of flows from the flashback annulus 520 and gaps 508. Without being bound to a particular theory, it is believed that this design for supplementing the flashback annulus air flow provides for superior reduction, or elimination of, flashbacks under a range of gas turbine operating conditions.

Also viewable in FIG. 5A is a cut-out 522 along the upstream end 503 of sleeve 502. This cut-out 522 accommodates the placement of the more downstream of two pins 560, which are welded or otherwise affixed to the main swirler assembly 512 at one end and welded or otherwise affixed to the combustor outer liner (not shown in FIG. 5A or 5B) at the other end of each pin 560.

Figure 6B:
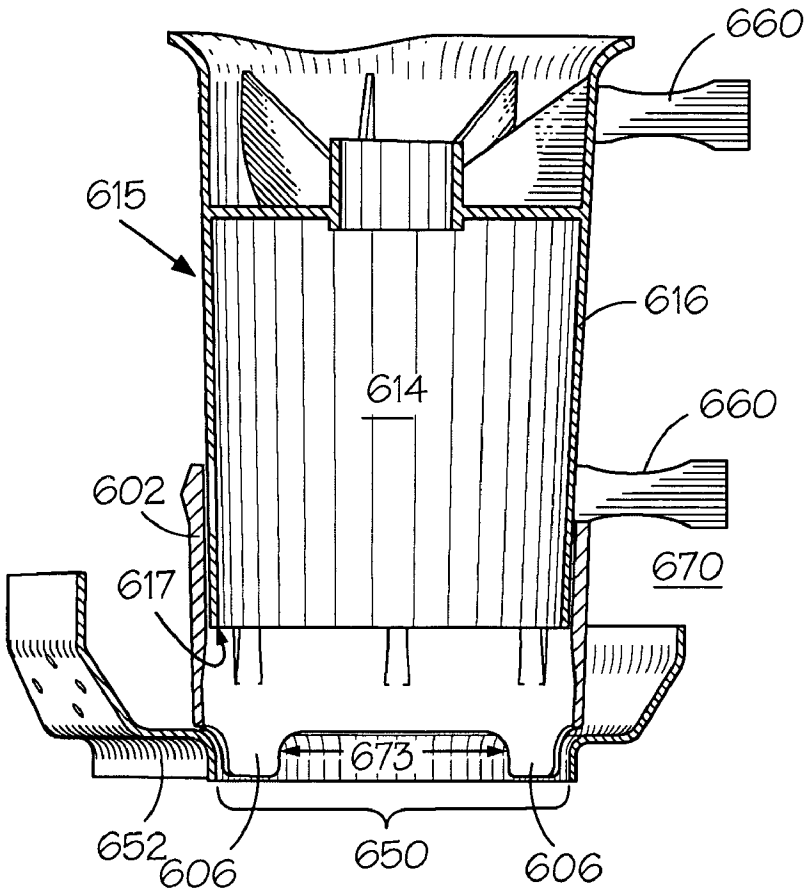
FIG. 6B depicts that sleeve embodiment in a cross-sectional side view of a main swirler assembly of the present invention meeting a base plate according to the present invention.
Figure 6A:
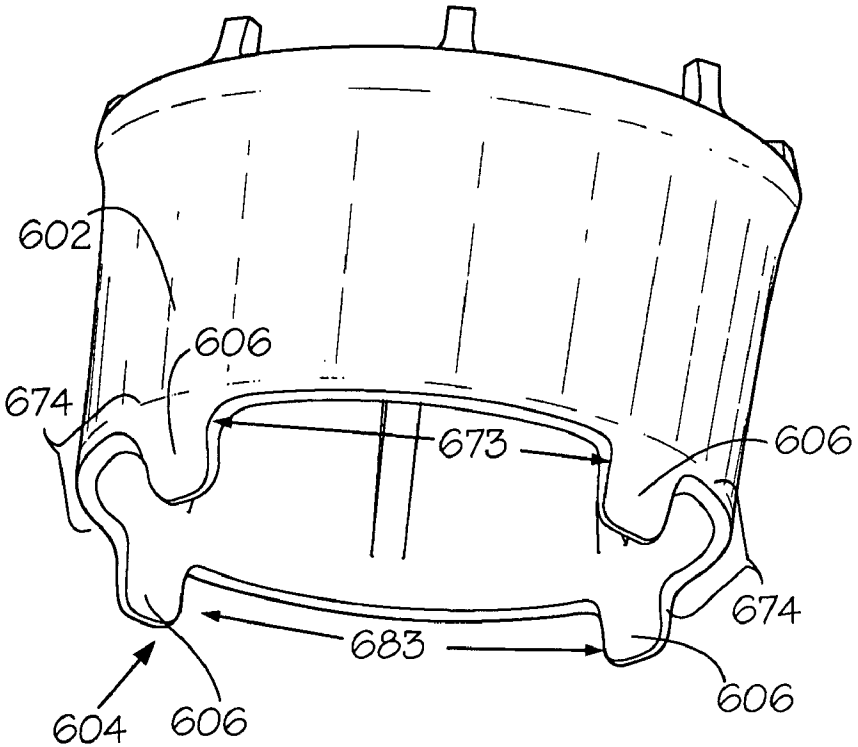
FIG. 6A is a perspective side view of another embodiment of a sleeve according to the present invention that comprises a plurality of gaps along its downstream end.

The air from the second peripheral air entry need not be unbiasedly distributed around the periphery. In fact, providing relatively more air to certain base plate areas adjacent the opening for a main swirler assembly is believed to help solve a potential flashback problem in certain embodiments. For example, FIGS. 6A and 6B depict an embodiment in which the second peripheral air entry additionally is adapted to provide relatively more air to selected areas adjacent the base plate. This is directed to reduction or elimination of flashback damage to areas identified as more likely to sustain such damage. FIGS. 6A and 6B respectively provide a three dimensional perspective view of another sleeve 602, and a side cut-away view of that sleeve 602 as part of a main swirler assembly 615 positioned in an opening 650 of base plate 652. The major difference between the embodiment depicted in FIGS. 6A and 6B and the embodiment depicted in FIGS. 5A and 5B is that tabs 606 are non-equally distributed along downstream end 604 of sleeve 602, so that there are two larger gaps 673, and two small smaller gaps 674. The larger gaps 673 are aligned in the opening 650 so as to provide greater air flow from space 670 through what are defined in the following paragraph as the "inboard area" and the "outboard area" of the "high-flashback-occurrence zone."

Figure 7:
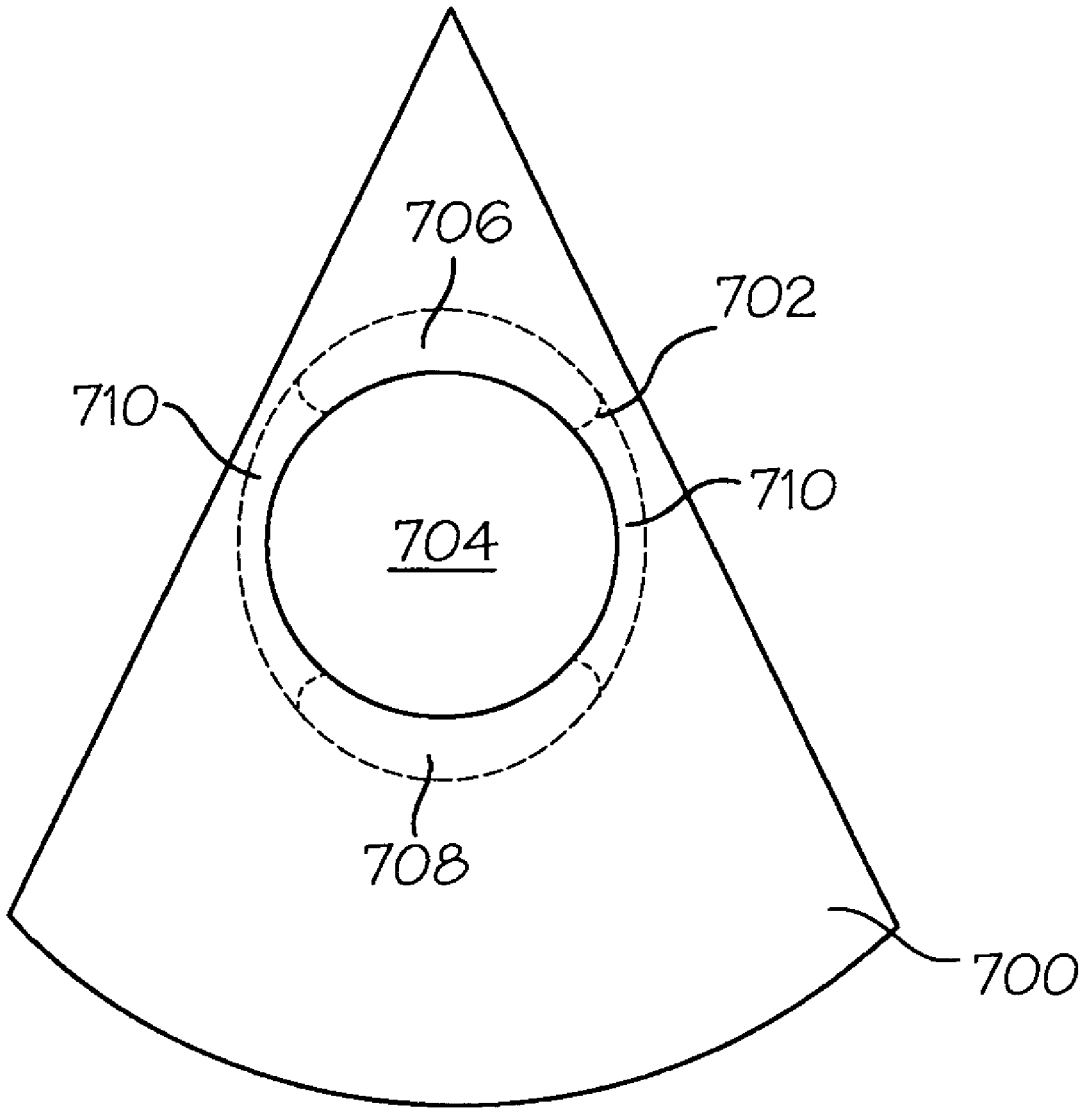
FIG. 7 provides an enlarged simplified view of portion of the base plate, depicting a high-flashback-occurrence zone around one opening for a main swirler assembly.

That is, without being bound to a particular theory, some embodiments of the present invention are effective to reduce the sizes of zones of high flashback occurrence, and/or, consequently the frequency of flashbacks and/or flashback-related structural damage. For example, FIG. 7 provides a simplified view of a portion of a base plate 700 depicting a high-flashback-occurrence zone 702 around a base plate opening 704 for a main swirler assembly (however, not depicting ventilation holes, nor aspects near the perimeter or the central pilot). This zone 702 is that part of base plate 700 between the large dashed lines and opening 704. Based on its proximity to the fuel/air mixture that flows from a respective main swirler assembly, this zone 702 is considered to have a substantially lower margin or safety against flashbacks. An inboard area 706 (disposed toward a centerline of the respective combustor (such as identified by the nozzle 16 and the fuel flow 56 in FIG. 1)) and an outboard area 708 (disposed toward the periphery of the respective combustor) of the zone 702 (demarcated by the small dashed lines) may experience relatively higher amounts and/or severity of flashbacks than the side areas 710 of zone 702 when the plant is operated outside of its design conditions. Thus, structural damage may occur more frequently in inboard area 706 and in outboard area 708 compared to side areas 710. To the extent that flow dynamics are modified in various embodiments of the present invention to reduce flashbacks in these areas, these embodiments are effective to reduce the frequency of flashbacks and/or the total area of these regions of structural damage. With specific regard to FIGS. 6A and 6B, without being bound to a particular theory, it is believed that positioning larger gaps 673 to align with inboard and outboard areas that correspond to areas 706 and 708 of FIG. 7 will result in a higher margin of safety against flashback, and/or, consequently the frequency of flashbacks and/or flashback-related structural damage during off-normal operations. More generally, any embodiments of the present invention may be utilized to disproportionately provide more air flow, such as by relatively larger gaps, to inboard and outboard areas that correspond to areas 706 and 708 of FIG. 7.

Figure 8B:
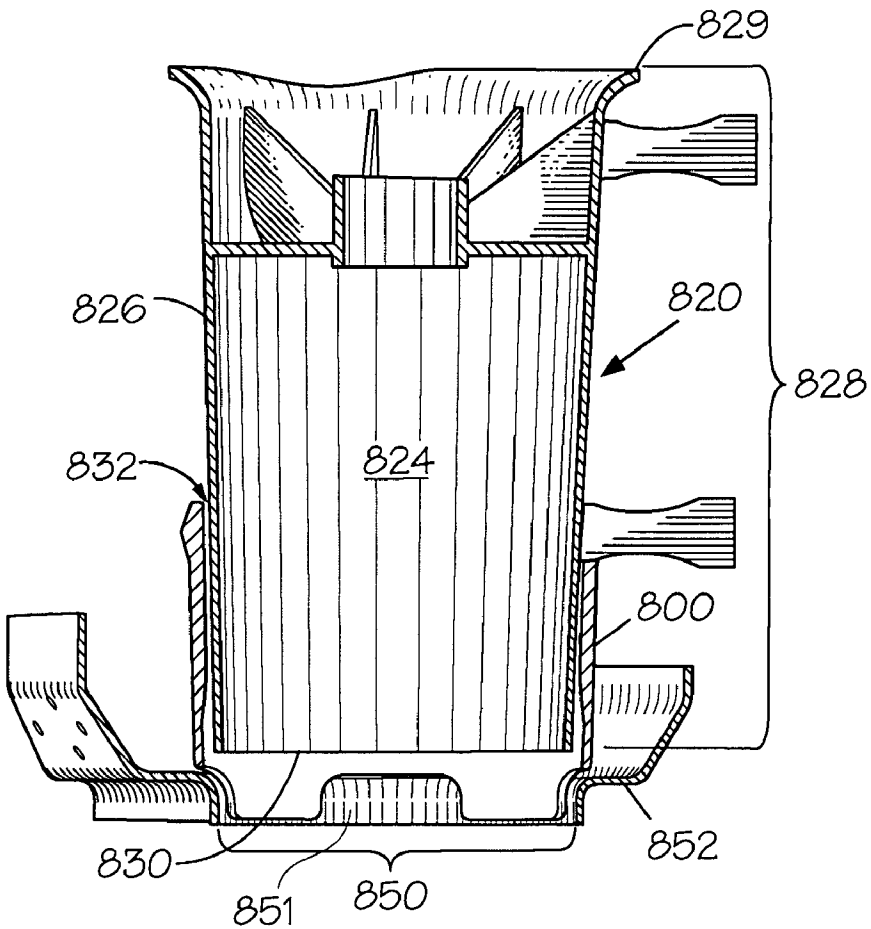
FIG. 8B depicts that sleeve embodiment in a cross-sectional side view of a main swirler assembly of the present invention meeting a base plate according to the present invention.
Figure 8A:
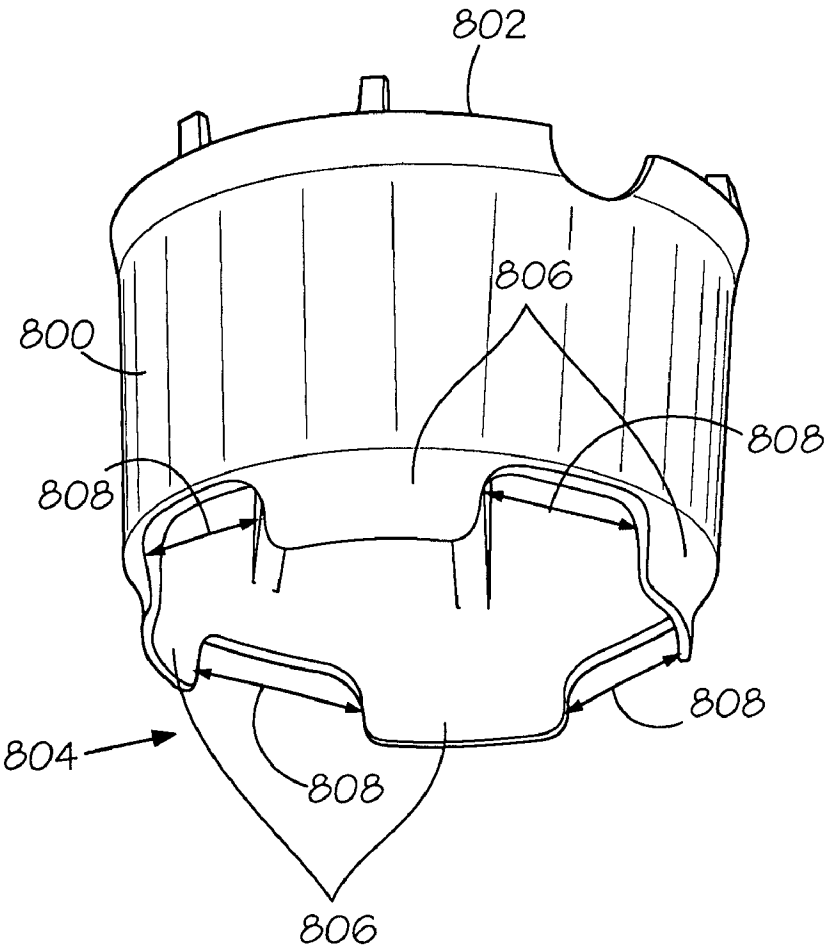
FIG. 8A is a perspective side view of another embodiment of a sleeve according to the present invention that comprises a plurality of gaps along its downstream end.

The present invention includes numerous variations of the total percentages of the circumference of the downstream end of a sleeve that is occupied by gaps and by tabs. These embodiments retain the main features of the present invention, and are provided merely as illustrative of alternative designs. As one example, FIG. 8A provides a three-dimensional perspective view of a sleeve 800. FIG. 8B provides a side cut-away view of that sleeve 800 as part of a main swirler assembly 820 positioned in an opening 850 of base plate 852.

Referring to FIG. 8A, the sleeve 800 has an upstream end 802 and a downstream end 804. Along the downstream end 804 are four tabs 806, each such tab 806 having a circumferential span (i.e., annular width) corresponding to 45 degrees of a 360-degree circle defining the circumference of the sleeve 800 at its downstream end 804. The four tabs 806 are evenly spaced apart to define four identically-sized gaps 808 between the tabs 806.

Referring to FIG. 8B, a side cut-away view of a main swirler assembly 820 comprising an inner body 824 within its casing 826, and the sleeve 800. The main swirler assembly 820 is depicted positioned into a respective opening 850 of base plate 852. So positioned, each of said tabs 806 is adapted to engage a respective portion of a lateral edge 851 that defines the opening 850 of base plate 852.

As observable in FIG. 8B, the casing 826 has a length 828 defined as the distance between a front end 829 disposed upstream and an exhaust end 830 disposed downstream. This casing 826 has a longer length 828 compared to the casing 516 shown in FIG. 5B. This greater length provides for a longer flashback annulus 832. As discussed more fully in U.S. patent application Ser. No. 10/984,526, filed Nov. 9, 2004, and entitled "An Extended Flashback Annulus" , which is incorporated specifically for such teachings, an extended flashback annulus such as that depicted in FIG. 8B provides a more effective air flow from the flashback annulus 832. Without being bound to a particular theory, an extended flashback annulus in combination with an arrangement of gaps between tabs, such as depicted in the figures herein, including FIGS. 8A and 8B, provides a combination of a first peripheral air entry and a second peripheral air entry, the gaps 808, that is effective to reduce or eliminate flashback.

Figure 9B:
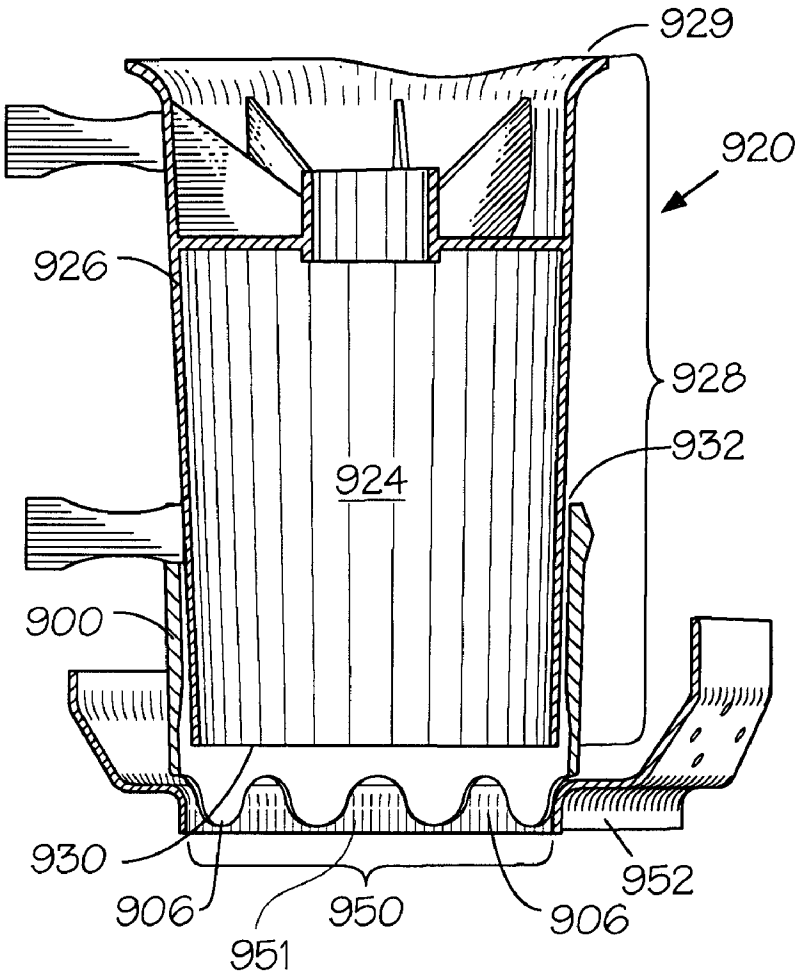
FIG. 9B depicts that sleeve embodiment in a cross-sectional side view of a main swirler assembly of the present invention meeting a base plate according to the present invention.
Figure 9A:
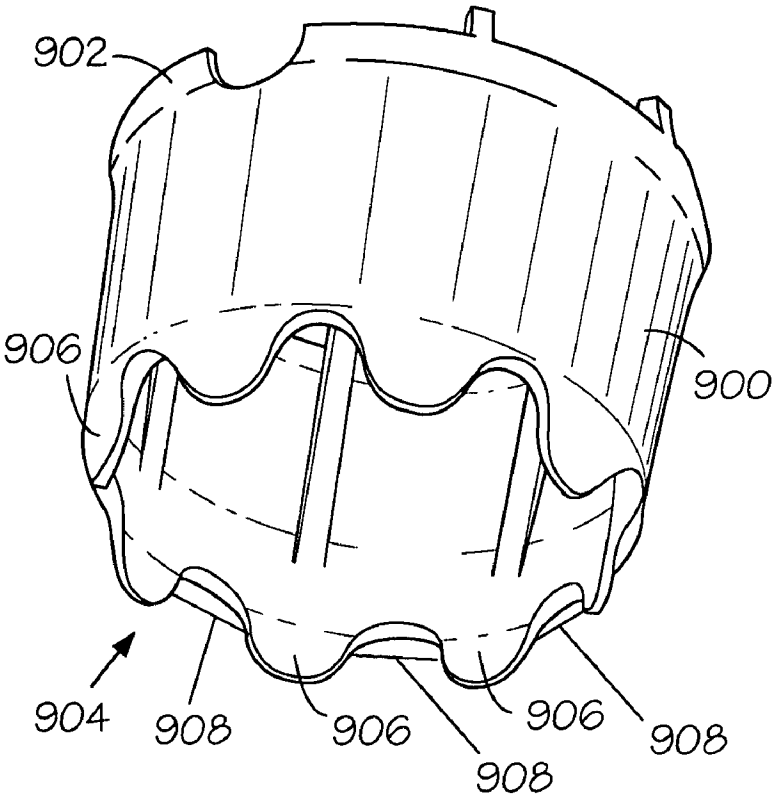
FIG. 9A is a perspective side view of another embodiment of a sleeve according to the present invention that comprises a plurality of gaps along its downstream end.

The shapes of the tabs and gaps is not meant to be limiting. As one example of possible variations, FIGS. 9A and 9B depict one embodiment that comprises tabs and gaps having scalloped, sinusoidal curvature. FIG. 9A provides a three-dimensional perspective view of a sleeve 900. FIG. 9B provides a side cut-away view of that sleeve 900 as part of a main swirler assembly 920 positioned in an opening 950 of base plate 952.

Referring to FIG. 9A, the sleeve 900 has an upstream end 902 and a downstream end 904. Along the downstream end 904 are eight tabs 906, each such tab 906 having a scalloped, sinusoidal curvature. The eight tabs 906 are evenly spaced apart to define eight identically-sized gaps 908 between the tabs 906.

Referring to FIG. 9B, a side cut-away view of a main swirler assembly 920 comprising an inner body 924 comprising casing 926, and the sleeve 900. The main swirler assembly 920 is depicted positioned into a respective opening 950 of base plate 952. So positioned, each of said tabs 906 is adapted to engage a respective portion of a lateral edge 951 that defines the opening 950 of base plate 952. When so positioned, the sinusoidal shape of the gaps 908 effects the flow characteristics of air flowing through this second peripheral air entry.

As observable in FIG. 9B, a downstream the casing 926 has a length 928 defined as the distance between a front end 929 disposed upstream and an exhaust end 930 disposed downstream. This casing 926 has a longer length 928 compared to the casing 516 shown in FIG. 5B, but is shorter than the length 828 of the casing 826 in FIG. 8B. This length 928 provides for a moderately long flashback annulus 932, ending at a position that is about 25 percent of the length of the sleeve 900 upstream of the downstream end 904 of the sleeve 900. An extended flashback annulus such as that depicted in FIG. 9B is believed to provide an effective air flow along the periphery of the respective main swirler assembly, and to provide, in conjunction with the second peripheral air flow entry, i.e., the scalloped gaps 908, an additional alternative configuration for reduction or elimination of flashbacks.

Figure 10B:
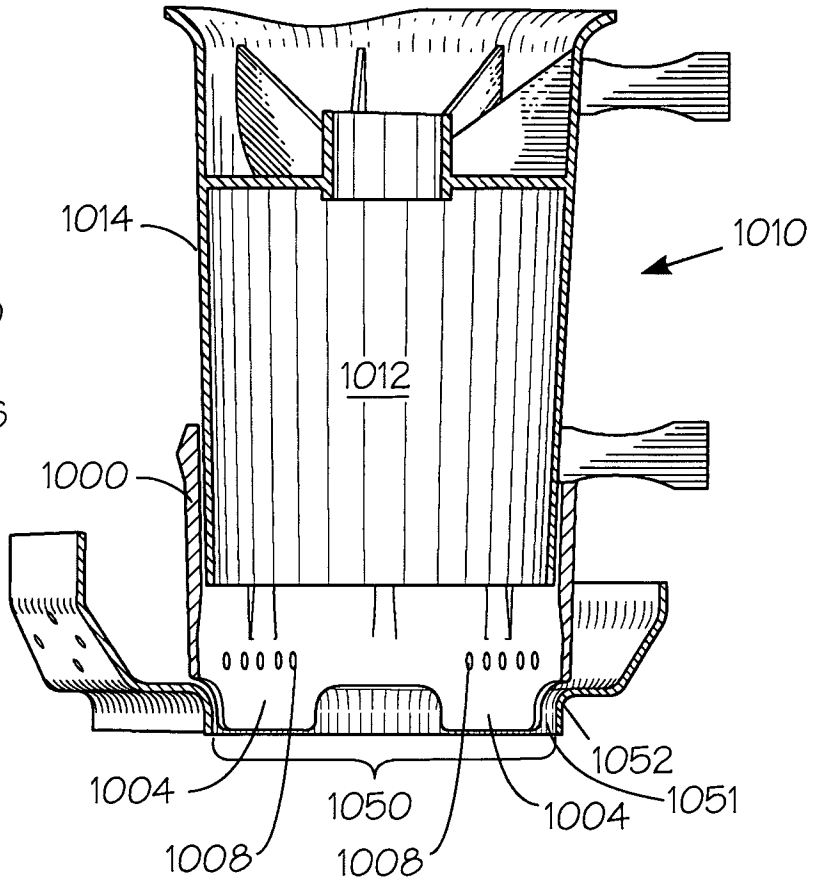
FIG. 10B depicts that sleeve embodiment in a cross-sectional side view of a main swirler assembly of the present invention meeting a base plate according to the present invention.
Figure 10A:
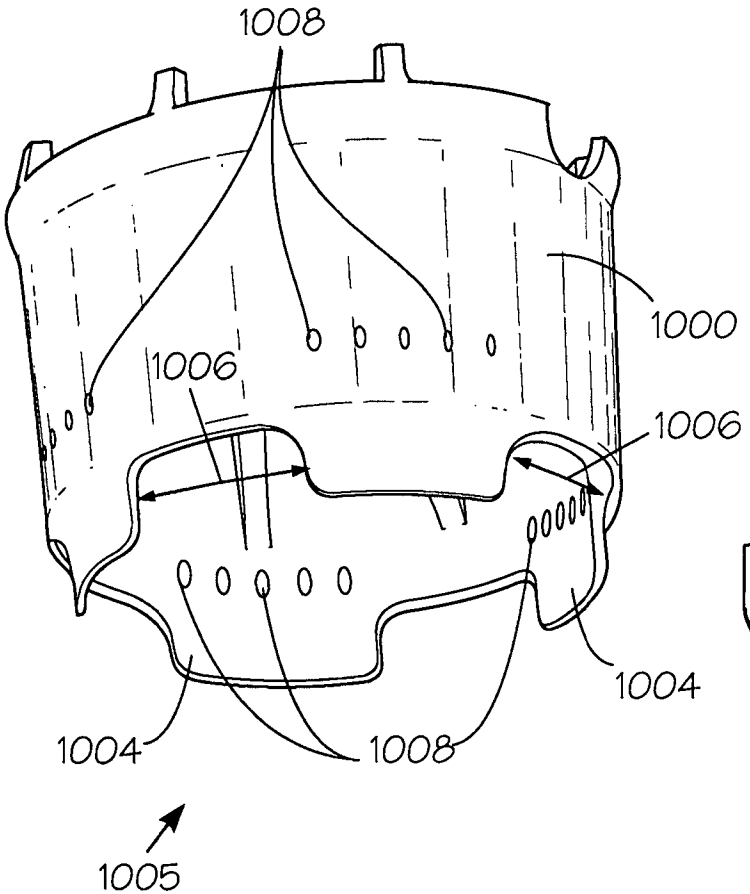
FIG. 10A is a perspective side view of another embodiment of a sleeve according to the present invention, showing both gaps and series of holes.

FIGS. 10A and 10B provide another alternative for modifying the flow of air along the periphery of the air flow emanating from a main swirler assembly in a gas turbine. FIG. 10A provides a perspective view of a sleeve 1000 that comprises four evenly spaced tabs 1004 having each occupying about 45 degrees of the circumference of a circle defining the downstream end 1005 of the sleeve 1000. Between the tabs 1004 are four uniformly sized gaps 1006. Disposed above each tab 1004 are five evenly spaced holes 1008 that are drilled to provide additional air flow to account, at least in part, for the blockage of air caused by the respective tabs 1004. In one particular embodiment, each of these holes 1008 is inclined inwardly and downstream at an angle of approximately 30 degrees, and has a diameter of about 1.8 millimeters ("mm").

While not depicted, it is noted that other embodiments include one or more rows of holes, such as the holes 1008 of FIG. 10A, that, however, are arranged to extend circumferentially in a plane upstream of the upstream ends of the gaps (such as gaps 1006 of FIG. 10B) and tabs (such as the tabs 1004 of FIG. 10B). That is, the one or more rows of holes include holes that are above gaps as well as tabs. These one or more rows of holes provide for entry of additional air into the total air flow of a respective main swirler assembly. Alternatively, in some embodiments a plurality of holes for entry of additional air may be provided that are not arranged in such one or more rows. For example, not to be limiting, a plurality of holes may be provided to add more air to the inboard and outboard areas (see discussion of FIG. 7), and not to the side areas. Such embodiments with a plurality of holes not arranged in continuous rows may include gaps and tabs, or may be without gaps and tabs. Such embodiments include those that provide for a percentage of total flow of air through a particular main swirler assembly that falls within the ranges set forth below.

FIG. 10B provides a side cut-away view of a main swirler assembly 1010 comprising an inner body 1012 comprising a casing 1014, and the sleeve 1000. The main swirler assembly 1010 is depicted positioned into a respective opening 1050 of base plate 1052. So positioned, each of said tabs 1004 is adapted to engage a respective portion of a lateral edge 1051 that defines the opening 1050 of base plate 1052.

More generally, for any of the above embodiments, it is appreciated that a particular arrangement of gaps, a particular arrangement holes, or a particular combination of gaps and holes in a sleeve, provide for passage of a certain percentage of the total flow of air through a respective main swirler assembly during operation of a gas turbine of which it is a component. For example, not to be limiting, and assuming that the total mass (air and fuel) going through a main swirler assembly during operation of the gas turbine is designated as 100 percent, then in certain embodiments of the present invention (including any of the above designs of embodiments) the following percentages of the total mass (based on air and fuel) pass through the respectively indicated areas/components:

Through the bore of the main swirler (i.e., a centrally located mixture of fuel and air)—about 88 to about 94 percent of the total mass;

Through the first peripheral air entry (i.e., the flashback annulus)—about 4.0 to about 7.5 percent of the total mass; and Through the second peripheral air entry (i.e., gaps, holes, or gaps and holes)—about 1.5 to about 5.0 percent of the total mass.

Thus, the embodiments of the present invention provide for a shifting of the relative percentages of centrally located fuel/air mixture and the total quantity of peripherally located air, so as to provide a relatively higher percentage of total air flow as peripherally located air. While not being bound to a particular theory, this is believed to provide for more stable operations, with fewer flashback occurrences, while still maintaining an economical operation. This also is believed, under certain conditions, to shift the pattern of combustion farther downstream of the main swirler assembly, as when there is a relatively rich fuel/air mixture emanating from the bore of the main swirler assembly and mixing with the peripherally located air is needed to properly combust this mixture.

Accordingly, in some particular embodiments of the present invention, the gaps at the downstream end of a sleeve, and/or holes in the sleeve (depending on the embodiment) are sized to provide between about 1.5 and about 5.0 percent of the total air flow (measured as total mass) through a main swirler assembly of which it is a part during operation of the gas turbine. In a subset of those particular embodiments, the gaps at the downstream end of a sleeve, and/or holes in the sleeve (depending on the embodiment), are sized to provide between about 2.5 and about 5.0 percent of the total air flow (measured as total mass) through a main swirler assembly of which it is a part. These levels of addition from the structures providing a second peripheral air entry combine with the quantity of air from the first peripheral air entry (i.e., the flashback annulus) to provide a quantity, direction and distribution effective to reduce or eliminate flashback without incurring loss of performance efficiencies.

As inferable from above, for the embodiments described in the previous paragraph, the relative flow through the bore of the main swirler assembly (or an analogous component of a main swirler assembly) is between about 88 to about 94 percent of the total air flow (measured as total mass). Also, the relative flow through a flashback annulus (or an analogous space) is between about 4 and about 7.5 percent of the total air flow (measured as total mass). In one group of embodiments, the flow through the combination of the first and the second peripheral air entries is from about 5.0 to about 10 percent of the total air flow (measured as total mass), and the flow through the bore of the main swirler assembly makes up the balance of 100 percent flow.

Other approaches may be utilized with the combination of providing a first and a second peripheral air entry to increase further the robustness and effectiveness of the air barrier or column. As one example, the gap, or space between the outside surface of the swirler assembly casing and the inside surface of the sleeve, is about 1.2 millimeters in certain prior art apparatuses. This gap may be widened to provide for additional air flow to form a more robust, more effective protective cylindrical air barrier. One way to widen this gap is to fabricate a swirler assembly shroud with a relatively smaller diameter, thereby leaving more space between it and the sleeve. Another way is to provide a redesigned sleeve with a larger inside diameter. These two approaches also may be effectuated in combination with one another. In making such changes, the upstream air supply and its distribution are attended to in order to assure that sufficient air flow and pressure are available for entry into the flashback annulus, so that widening the flashback annulus does not merely result in a weaker protective cylindrical air barrier. Also, a wider flashback annulus may, in some embodiments, result in a design that permits a relatively shorter length of the flashback annulus. Embodiments of extended and/or protected flashback annuluses that employ such approaches are considered within the scope of the present invention. It is noted that widening a flashback annulus beyond a certain dimension may result in the percentage of total air flow passing through it exceeding about 7.5 percent, under a range of standard operating conditions for which the range of about 4 to about 7.5 percent was provided above.

Further, it is appreciated that certain embodiments of the present invention may include a base plate having one or more upstream-oriented lips for engaging one or more swirler assemblies that each comprise a sleeve that comprises one or more gaps as described above, with or without the upstream holes as described above. That is, an upstream-oriented base plate (alternatively described as a reversed-edged base plate), as disclosed in U.S. patent application Ser. No. 11/051,799, filed Feb. 4, 2005, and entitled, Can-Annular Turbine Combustors Comprising Swirler Assembly And Base Plate Arrangements, And Combinations, may be a component of, or may be utilized with, certain embodiments of the present invention. This application is incorporated by reference for the teaching of the use of a reversed-edged base plate, however, appreciating that certain embodiments of the present invention as described herein comprise a sleeve that is modified appropriately to join with the opening of the reversed-edged base plate. Such embodiments may also comprise the mating of an opening of a reversed-edged base plate to a sleeve with tabs (or with tabs and holes).

Figure 11A:
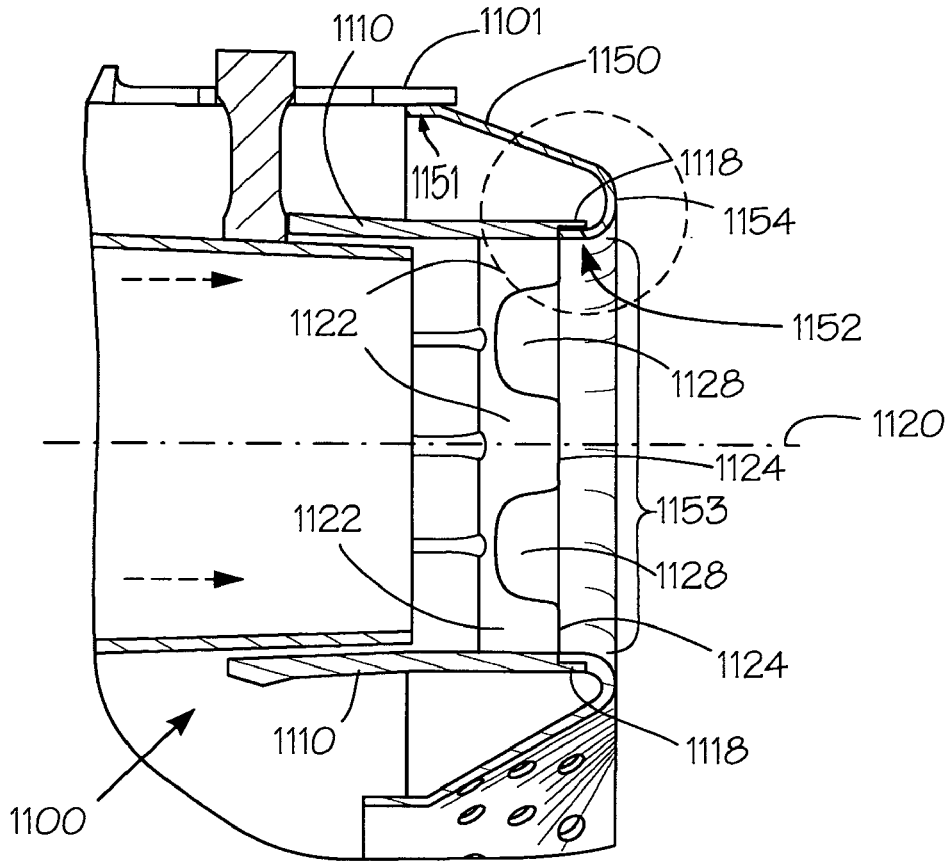
FIG. 11A is a partial cross-sectional side view one embodiment of a main swirler assembly of the present invention meeting a reversed-edged base plate according to the present invention. Also viewable are other components, in side cross section, of a gas turbine combustor.
Figure 11B:
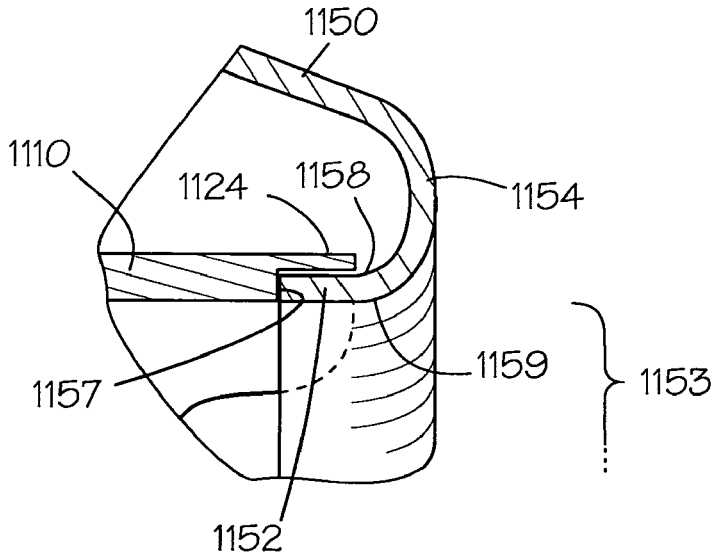
FIG. 11B is an enlarged cross-sectional side view of the area encircled in FIG. 11A.

Various alternatives of machining the respective joining surfaces of an upstream-oriented lip of an opening of a base plate and a downstream edge of a sleeve are described in the above-noted application. One example, not to be limiting, as applied to the tabs of embodiments of the present invention, is shown in FIGS. 11A-B. FIG. 11A is shows a side cross-sectional view of a downstream portion of a main swirler assembly 1100 positioned within an outer liner 1101 of a gas turbine combustor (not shown in its entirety). FIG. 11B shows the detail of the encircled structure in FIG. 11A.

Referring to FIG. 11A, a base plate 1150 can be anchored to the outer liner 1101 by welds (not shown) along a base plate outer edge 1151. Moving centrally from the attachment of the base plate 1150 with the outer liner 1101, the base plate 1150 angles inward and downstream, then downward to a plane substantially transverse to axis 1120, to form a generally transverse face 1154. At each opening 1153 that is sized to receive a main swirler assembly (such as 1100), the base plate 1150 curves upstream ending in the upstream disposed lip 1152. This upstream curving presents one embodiment of an upstream-oriented base plate (alternatively described as a reversed-edged base plate). The opening 1153 as defined by the lip 1152 is circular when meeting a circular downstream end 1118 of the sleeve 1110. However, in that the downstream end 1118 of the sleeve 1110 comprises, in certain embodiments of the present invention, a plurality of spaced apart tabs 1122, which have downstream edges 1124, it is these downstream edges 1124 that engage a respective portion of the upstream disposed lip 1152. This is viewable in FIG. 1A, in which two tabs 1122 are bisected by the cut-away of the figure, two gaps 1128 are shown between these two tabs 1122, and a single tab 1122 is between these two gaps 1128.

The engagement of the downstream edges 1124 and the lip 1152 are viewed at greater enlargement in FIG. 11B, a detail of the encircled structure in FIG. 11A. Thus, as shown in FIG. 11B, the base plate opening 1153 is defined by a ring-like, or annular, lip 1152 that is oriented in the upstream direction. This lip 1152, which is one form of a 'lateral edge,' has an upstream surface 1157, an outboard surface 1158, and an inboard surface 1159. The downstream edge 1124 of a tab 1122 is machined to meet the upstream surface 1157 and at least a portion of the outboard surface 1158. In certain embodiments of the present invention, this meeting is a tight, engaging fit, which for this embodiment provides a tolerance between 0 and 3 thousandths of an inch. This provides for axial movement during thermal expansion yet also provides for a desired elevation of the natural frequency of the main swirler assembly 1100. The contour of the downstream edge 1124 portion of tab 1122 that is below the lip 1152 in FIG. 11B is indicated by a dashed line.

The design of the overlapping junction between the downstream edge 1124 of a tab 1122 and the upstream disposed lip 1152 is not meant to be limiting. Any other type of junction for engagement of these components may be used so long as it is effective to provide a desired degree of structural support, and, for a meeting (of the downstream end of the sleeve with the upstream oriented lip of the base plate) in which the fit is tight, to increase the natural frequency of the main swirler assembly. Also, it is appreciated that any of the arrangements of gaps and tabs (or holes, or combinations of gaps and tabs with holes) shown in FIGS. 4A to 6B and 8A to 11B are believed suitable for engagement with a lip of an upstream-oriented base plate (such as is described in the above paragraphs).

Further, although as used in this specification, a lip of a base plate that meets a sleeve may be referred to as annular to describe the generally ring-like shape of the surface, it is appreciated that other shapes may be utilized to conform to alternative shapes of a downstream end of a sleeve, or other structure substituting for this. This applies to conventional openings of a base plate and to the upstream-oriented lip as described immediately above.

Also, it is appreciated that any of a number of designs for the respective engagement surfaces of the downstream end of the sleeve and the opening of the base plate may be utilized. Some examples are disclosed in U.S. patent application Ser. No. 11/051,799, filed Feb. 4, 2005, and entitled, Can-Annular Turbine Combustors Comprising Swirler Assembly And Base Plate Arrangements, And Combinations (), which is incorporated by reference for these teachings and, inter alia, the teachings of tolerances of fit. However, these examples are not meant to be limiting. For example, other shapes of the lip (i.e., a species of the 'lateral edge') includes shapes that have a curved, or curvilinear, transition from the inboard to the upstream to the outboard surfaces of the lip. Such other shapes are within the scope of the present invention.

Although most of the above disclosure and figures provide for an engaging radial fit between the sleeve and base plate lateral edge, this is not meant to be limiting. A respective lateral edge of a base plate may receive the downstream end of the sleeve by various fits. For example, as noted in the discussion of FIGS. 3, 4A and 4B, embodiments of the present invention include fits that are not so engaged, such as axially-aligned fits.

Finally, it should be understood that the examples and embodiments described herein are for illustrative purposes only. Thus, while some specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

We claim as our invention:

1. A gas turbine can-annular combustor comprising:

a main swirler assembly comprising:

i. an inner body comprising a front end and an exhaust end defining an axis of axial flow therebetween for passage of a fuel/air mixture during operation of the gas turbine;

ii. swirler flow conditioning members disposed about the axis of axial flow of the inner body:

iii. a sleeve, comprising an upstream end and a downstream end, disposed peripherally about the inner body and wherein the exhaust end of the inner body extends into the sleeve through its upstream end, therebetween defining a first peripheral air entry, and the sleeve additionally comprising a plurality of spaced apart tabs projecting substantially axially from the downstream end, each of said tabs adapted to engage a respective portion along an opening of a base plate, the sleeve further comprising a second peripheral air entry defined by gaps between the spaced apart tabs, and b. a base plate extending transversely across the combustor to form a barrier comprising a lateral edge defining an opening for the main swirler assembly, the lateral edge receiving the downstream end of the sleeve, wherein combined air flows from the first and said second peripheral air entries are effective during operation to reduce or eliminate flashback.

2. The combustor of claim 1, wherein the second peripheral air entry provides between about 1.5 and about 5.0 percent of a total air mass exiting the main swirler assembly during operation of the gas turbine.

3. The combustor of claim 1, wherein the sleeve downstream end is sized so mat the base plate lateral edge engages the downstream end, whereby vibration damping is enhanced.

4. The combustor of claim 1, the second peripheral air entry further comprising a plurality of holes.

5. The combustor of claim 4, wherein said plurality of holes is comprised of at least one row of holes formed circumferentially around the sleeve.

6. The combustor of claim 5, wherein the second peripheral air entry provides between about 1.5 and about 5.0 percent of a total air mass exiting the main swirler assembly during operation of the gas turbine.

7. The combustor of claim 1, the downstream end contoured to engage an upstream-oriented lip of the opening, the lip comprising an upstream surface, an inboard surface, and an outboard surface.

8. The combustor of claim 7, a fit between the downstream end and the lip effective to elevate the natural frequency of the main swirler assembly above 700 cycles per second.

9. The combustor of claim 1, the opening comprising an inboard area disposed toward a central axis of the combustor, and an outboard area disposed toward a periphery of the combustor, and the sleeve comprising two opposingly spaced gaps, wherein one of the two opposingly spaced gaps is positioned along the inboard area, and the other of the two opposingly spaced gaps is positioned along the outboard area.

10. A gas turbine comprising the combustor of claim 1.

11. A main swirler assembly for a gas turbine combustor, the main swirler assembly comprising a. an inner body comprising a front end and an exhaust end defining an axis of axial flow therebetween for passage of a fuel/air mixture during operation of the gas turbine;

b. swirler flow conditioning members disposed about the axis of axial flow of the inner body; and c. a sleeve, comprising an upstream end and a downstream end, disposed peripherally about the inner body and wherein the exhaust end of the inner body extends into the sleeve through its upstream end, therebetween defining a first peripheral air entry, and the sleeve additionally comprising a plurality of spaced apart tabs projecting substantially axially from the downstream end. each of said tabs adapted to engage a respective portion along an opening of a base plate of the combustor, the sleeve further comprising second peripheral air entry defined by gaps between the spaced apart tabs, wherein combined air flows from the first and said second peripheral air entries are effective during operation to reduce or eliminate flashback.

12. The main swirler assembly of claim 11, the sleeve downstream end comprising 8 tabs, each having a span representing about 15 degrees, and 8 gaps interspersed between the 8 tabs.

13. The main swirler assembly of claim 11, wherein each of two opposingly spaced gaps have a span representing between about 40 and 50 degrees.

14. A main swirler assembly for a gas turbine combustor, the main swirler assembly comprising a. an inner body comprising a front end and an exhaust end defining an axis of axial flow therebetween for passage of a fuel/air mixture during operation of the gas turbine;

b. swirler flow conditioning members disposed about the axis of axial flow of the inner body; and c. a sleeve, comprising an upstream end and a downstream end, disposed peripherally about the inner body and wherein the exhaust end of the inner body extends into the sleeve through its upstream end, therebetween defining a first peripheral air entry, and the sleeve downstream end additionally comprising four spaced apart tabs to engage a respective portion along an opening of a base plate of the combustor, the sleeve further comprising a second peripheral air entry defined by gaps between the spaced apart tabs, wherein the sleeve downstream end comprises 4 spaced apart tabs that have a span representing about 30 degrees, and further comprises 4 gaps interspersed between the 4 tabs wherein combined air flows from the first and said second peripheral air entries are effective during operation to reduce or eliminate flashback.

15. The main swirler assembly of claim 14, wherein each of the four gaps have a span representing about 60 degrees.

16. The main swirler assembly of claim 14, wherein two of the four gaps are opposing and each has a span representing more than about 60 degrees.

17. A main swirler assembly for a gas turbine combustor, the main swirler assembly comprising a. an inner body comprising a front end and an exhaust end defining an axis of axial flow therebetween for passage of a fuel/air mixture during operation of the gas turbine;

b. swirler flow conditioning members disposed about the axis of axial flow of the inner body; and c. a sleeve, comprising an upstream end and a downstream end, disposed peripherally about the inner body and wherein the exhaust end of the inner body extends into the sleeve through its upstream end, therebetween defining a first peripheral air entry, and the sleeve downstream end additionally comprising four spaced apart tabs to engage a respective portion along an opening of a base plate of the combustor, the sleeve further comprising a second peripheral air entry defined by gaps between the spaced apart tabs, wherein each tab comprises a span representing about 45 degrees;

wherein combined air flows from the first and said second peripheral air entries are effective during operation to reduce or eliminate flashback.

18. The main swirler assembly of claim 17, additionally comprising at least one row of holes upstream of each of the four tabs, on the sleeve.

19. The main swirler assembly of claim 18, wherein the holes are inclined at about 30 degrees inward from an upstream-to-downstream axis of the sleeve.

* * * * *